US008167290B2

(12) United States Patent
Lauzier et al.

(10) Patent No.: US 8,167,290 B2
(45) Date of Patent: May 1, 2012

(54) RECONFIGURABLE PALLET USING PINS AND HOLLOW SUPPORTS

(75) Inventors: Nicolas Lauzier, Ste-Flavie (CA); Robin Stevenson, Bloomfield, MI (US); Dalong Gao, Troy, MI (US); Robert Jacob Scheuerman, Washington, MI (US); Chi-Hung Shen, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 1030 days.

(21) Appl. No.: 12/115,899

(22) Filed: May 6, 2008

(65) Prior Publication Data

US 2009/0277359 A1 Nov. 12, 2009

(51) Int. Cl.
*B23Q 1/25* (2006.01)

(52) U.S. Cl. ..... 269/71; 269/55; 269/72

(58) Field of Classification Search ..... 269/55, 269/71, 72
See application file for complete search history.

(56) References Cited

U.S. PATENT DOCUMENTS 5,026,033 A * 6/1991 Roxy ..... 269/45
5,107,599 A * 4/1992 Marincic et al. ..... 33/573
5,547,330 A * 8/1996 Walimaa et al. ..... 414/749.6

* cited by examiner

*Primary Examiner* — Lee D Wilson
*Assistant Examiner* — Shantese McDonald
(74) *Attorney, Agent, or Firm* — Quinn Law Group, PLLC

(57) ABSTRACT

A pallet includes a platform and a plurality of support assemblies located at multiple positions on the platform. One support assembly is associated with each location of the component to be supported. Each support assembly has a linkage assembly to support and enable movement of a support element. The support assemblies also each include multiple bases secured to the platform, to position the support element in a desired location for each version of a component. An alignment mechanism on each base allows for rotational alignment of the support element relative to the pallet.

17 Claims, 5 Drawing Sheets

RECONFIGURABLE PALLET USING PINS AND HOLLOW SUPPORTS

TECHNICAL FIELD

The present invention relates generally to pallets for assembly plants, and more specifically to a reconfigurable pallet.

BACKGROUND OF THE INVENTION

During assembly of vehicles in an assembly plant individual components must be supported prior to installation in the vehicle. In the case of heavy or bulky components it may be necessary or desirable to support these components in a specific configuration which facilitates installation of the component into the vehicle. For example, it may be desirable to support the component in an orientation which corresponds to its in-vehicle orientation and in a manner which enables access to locations, such as boltholes, used to attach the component to the vehicle.

An example of this is a vehicle engine or powertrain (i.e. engine plus transmission), where engine and/or powertrain specific support structures are used for the purpose of presenting the engine or powertrain to the vehicle body in a manner which facilitates attachment of the engine or powertrain to the vehicle body.

Commonly, customers may be offered various hardware options, such as engines or powertrains, with a specific vehicle body. Hence, to meet the need described above, multiple support structures must be employed each of which will be specific to a single hardware option or component version and which will be incapable of being used for other options. Frequently, for convenience and to ensure their strength and rigidity, these support structures are mounted on a platform. Together the support structure and the platform to which is attached constitute a pallet. As a result, a unique pallet is required for each version of the component associated with the assembly line.

SUMMARY OF THE INVENTION

A pallet that can be reconfigured to support multiple versions of a component associated with an assembly line is desired.

A pallet of the present invention includes a platform and a plurality of support assemblies located at multiple positions on the platform. One support assembly is associated with each support location of the component. The support assemblies each include a support element and a plurality of bases, one base for each version of the component to be supported.

The support element is positioned on the desired base. An interface on the base for receiving a footing of the support element places the support element in the desired location. The support element includes a locator. Once positioned on the base, the locator corresponds to a predetermined location on the component which has a mount for alignment. The height of the interface places the locator at the appropriate height for the mount of that version of the component.

The support element may be constrained by a linkage assembly. The linkage assembly has a foundation secured to the platform. A first arm is rotatably connected to the foundation with a first joint and a second arm is rotatably connected to the first arm with a second joint. An aperture for receiving the support element is defined by the second arm.

An alignment mechanism is associated with each base. An extension protruding upwards from the base is received within a recess defined by the support element. The support element is positioned such that the recess is located above the extension. The support element is then rotated until an elongated portion is aligned with a planar wall on the base. Once aligned the support element can be moved vertically to seat the footing on the base. To configure the support assembly for another version of the component the footing is moved from the interface of the current base to the interface of another. The support element is rotated until the elongated portion and the planar wall of that base are in alignment.

The support assemblies allow the pallet to quickly and easily be reconfigured by a single operator. Associating an alignment mechanism with each base allows each support element to be rotationally positioned relative to the pallet providing precise mounting locations. Thus, the pallet accommodates relatively minimal lateral differences between desired mounting locations of different versions of the component. Providing a reconfigurable pallet to be used with multiple versions of a component on an assembly line reduces costs.

The invention also includes an improved method for reconfiguring a pallet. The method comprises positioning a support element above one of a plurality of bases via movement of a linkage assembly, rotating the support element until an elongated portion of the support element is aligned with a planar wall of the one of the plurality of bases, and sliding the support element relative to the linkage assembly to mount the support element on the one of the plurality of bases.

The above features and advantages, and other features and advantages of the present invention will be readily apparent from the following detailed description of the preferred embodiments and best modes for carrying out the present invention when taken in connection with the accompanying drawings.

DESCRIPTION OF THE PREFERRED EMBODIMENTS

Figure 1:
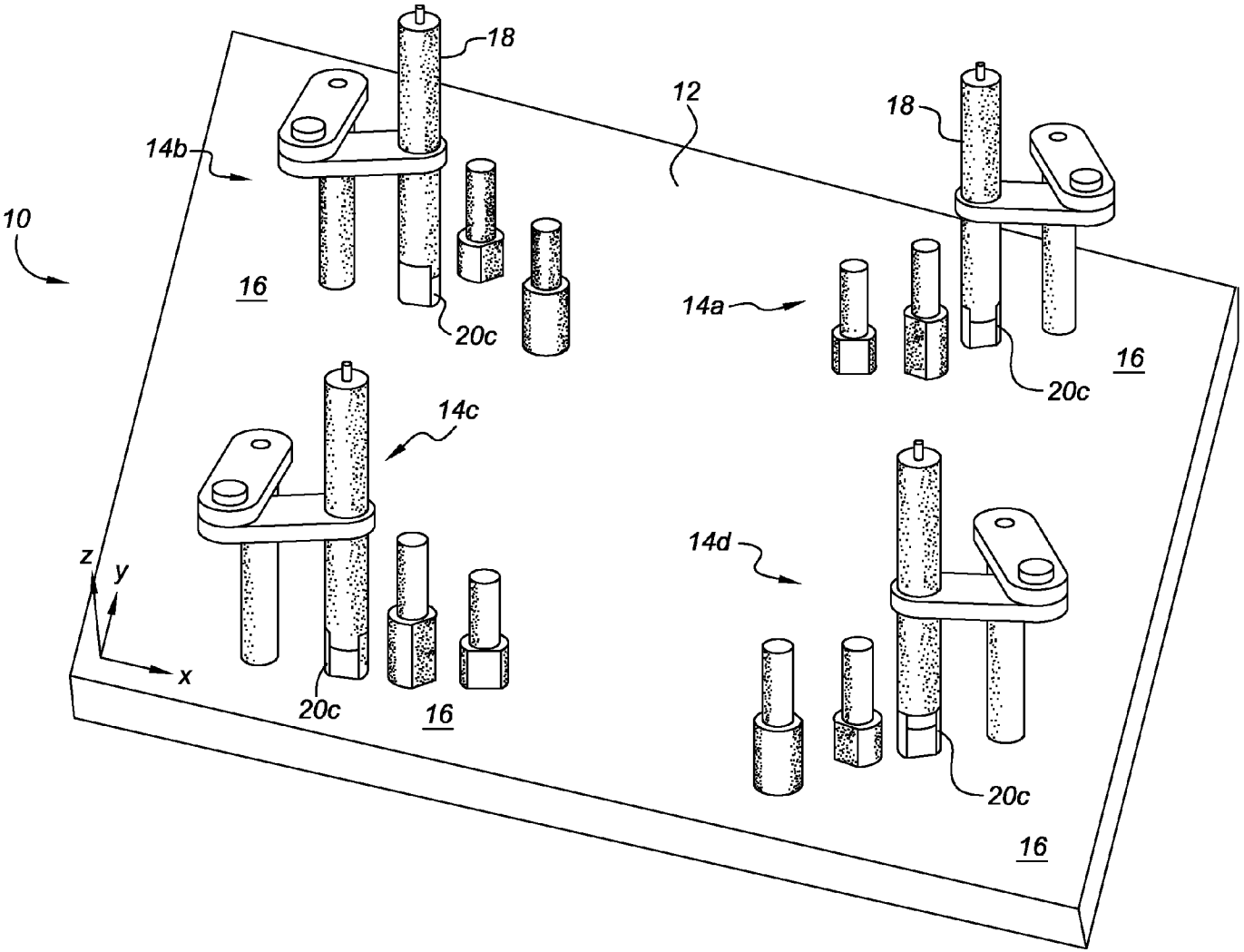
FIG. 1 is a perspective view illustrating a reconfigurable pallet of the present invention.

Referring to the Figures, wherein like reference numbers refer to the same or similar components throughout the several views, FIG. 1 is a perspective view of an exemplary pallet 10 of the present invention.

The pallet 10 includes a platform 12 and a plurality of support assemblies 14 located at multiple positions on the platform 12. As shown, four support assemblies 14*a-d* are located one at each corner 16 of the platform 12. One support assembly 14 is associated with each support location for the component. The number and location of the support assemblies 14 is determined by the design and type of the component to be supported. An x, y and z direction are defined by the pallet 10. Each support assembly 14*a-d* is located at a specific x-y-z coordinate as described below.

Figure 2:
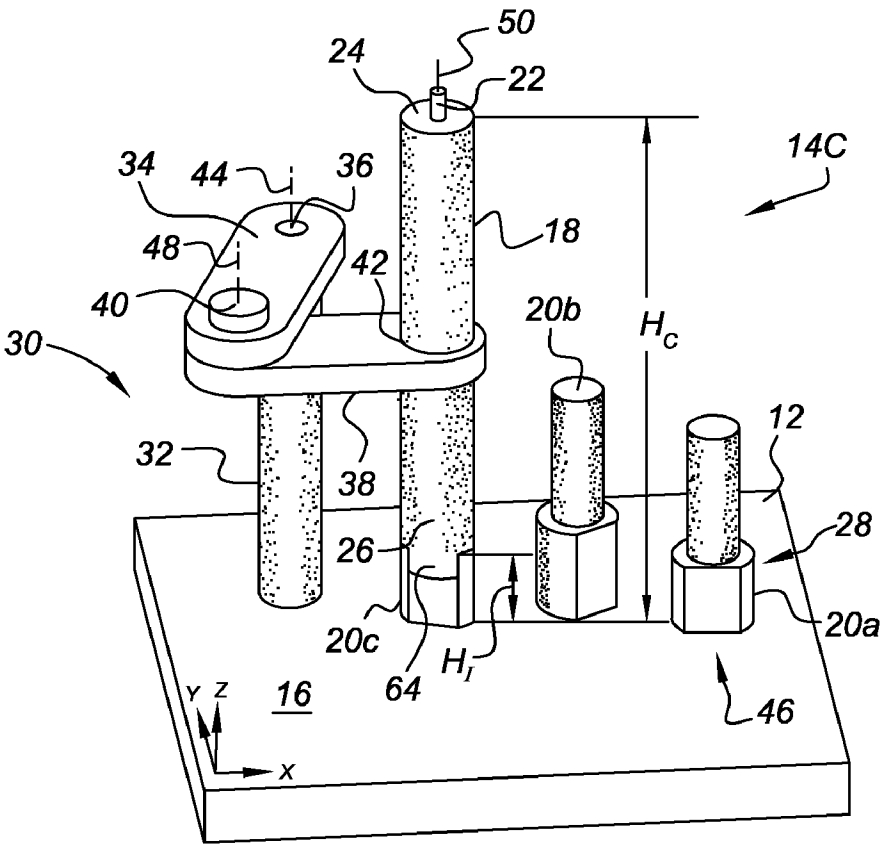
FIG. 2 is an enlarged perspective view of one support assembly for the pallet of the present invention.

FIG. 2 illustrates an enlarged perspective view of one section of the pallet 10 showing one of the support assemblies 14*c*. The other support assemblies 14 *a, b* and *d* on the pallet 10 are configured in the same manner as described herein. The support assembly 14*c* includes a support element 18 and a plurality of bases 20. Preferably, there are multiple bases 20, one base for each version of the component to be supported. In the embodiment of FIG. 2, there are three bases 20: a first base 20*a*, a second base 20*b*, and a third base 20*c*. Therefore, the example embodiment is of a pallet 10 for use with a component having three different configurations. For example, the component is an engine and three different engines are available for a vehicle assembled on the assembly line. The pallet 10 can be configured to support each version of the engine. Additional versions of the component can be accommodated by adding another base 20 at the appropriate location for each support assembly 14.

The support element 18 includes a locator 22 along an end 24, as shown. The locator 22 corresponds to a predetermined location on the component which has a mount for alignment with the locator 22. The locator 22 is positioned at a specific location and height to correspond to the component mount. In the embodiment shown, the locator 22 is a pin that could correspond to a female receptacle defined by the component at the mount. For example, the component is an engine and a pin receiver is positioned on the engine at the component mount location. Alternately, the locator 22 may be a support plane on the support element 18 that corresponds to a plane on the component at the mount. Other arrangements may be used for the locator 22, such as, a female receptacle defined by the locator 22 and a male coupling on the component at the mount.

The support element 18 is positioned on the desired base 20, in this instance base 20*c*. The support element 18 has a footing 26. The footing 26 couples with the desired base 20*c*. In the embodiment shown, the multiple bases 20*a-c* each have an interface 28 for mating with the footing 26. The interface 28 places the support element 18 in the desired x-y coordinate location. The interface height $H_I$ of the desired base 20*c* places the locator 22 at the appropriate component height $H_C$ for that version of the component. Therefore, each base 20*a-c* is associated with a specific x-y-z coordinate appropriate to the version of the component being supported on the pallet 10 by the base 20*a-c*.

The interface 28 includes an alignment mechanism 46. The alignment mechanism 46 places the support element 18 in the desired rotational alignment for that corresponding base 20, here base 20*c*. The locator 22 may be placed in an eccentric location relative to axis 50 of the support element 18. By providing rotational alignment of the support element 18 the locator 22 may be placed in multiple x-y coordinate positions that are relatively close to one another, as explained with respect to FIGS. 5 and 6*a-c*. The size of bases 20*a-c* may have the same diameter as support element 18 also, to provide multiple x-y coordinate positions that are relatively close to one another.

Each support element 18 is constrained by a linkage assembly 30. The linkage assemblies 30 guide and support the support element 18 and ensure that there are no loose parts associated with the pallet 10 to prevent dropping parts during pallet reconfiguration. However, the support element 18 could be detached from the linkage assembly 30 if so desired. Each linkage assembly 30 has a foundation 32 secured to the platform 12. A first arm 34 is rotatably connected to the foundation 32 with a first joint 36. A second arm 38 is rotatably connected to the first arm 34 with a second joint 40. An aperture 42 for receiving the support element 18 is defined by the second arm 38 and is positioned remotely from the second joint 40. The support element 18 can freely rotate and slide in the z direction when located within the aperture 42.

The first joint 36 rotatably connects the first arm 34 to the foundation 32. The first arm 34 rotates about a first axis 44 that is oriented in the z direction. The second joint 40 rotatably connects the second arm 38 with the first arm 34. The second arm 38 rotates about a second axis 48 that is also oriented in the z direction, and is parallel to the first axis 44. The x-y coordinate location of the second axis 48 may be changed by rotating the first arm 34 about the first axis 44. Once the support element is mounted on the interface 28 rotation of the first arm 34 about the first axis 44 and the second arm 38 about the second axis 48 is prevented. This prevents movement of the first arm 34 and the second arm 38 relative to the foundation 32 and thus, to the platform 12.

The support element 18 rotates within the aperture 42 about a third axis 50 that is oriented in the z-direction and parallel to the first and second axes 44 and 48. The x-y coordinate location of the third axis 50 may be changed by rotating the second arm 38 about the second axis 48 when the support element 18 is not received within the interface 28. Once the footing 26 is received by the interface 28, the x-y coordinate location of the third axis 50 is fixed. Gravity and the weight of the component restrict the support element 18 from moving along the third axis 50 during pallet 10 usage.

To configure the support assembly 14*c* for another version of the component the footing 26 is moved from the interface 28 of base 20*c* to the interface 28 of base 20*a* or 20*b*, as desired, and the support element 18 is moved within aperture 42 for vertical adjustment.

To reconfigure the entire pallet 10 this is repeated for each of the support assemblies 14*a-d* located on the pallet 10. To ensure proper positioning of the support element 18 for each of the support assemblies 14*a-d* the bases 20 may be colored or numbered alike for each version of the component. That is, base 20*a* of support assembly 14*c* has a matching color to a similar base 20*a* of each of the support assemblies 14*a, b* and *d* on the pallet 10. Base 20*b* of support assembly 14*c* would have another color matching each similar base 20*b* of each of the support assemblies 14*a, b* and *d* and base 20*c* of support assembly 14*c* would have a third color matching each similar base 20*c* of each of the support assemblies 14*a, b* and *d*. Positioning the footings 26 for each support assembly 14*a-d* with similarly colored bases 20 to one another would ensure that the locators 22 are in the proper location for each version of the component. For example, the component is an engine and each version of the engine would have a color associated therewith. All of the bases 20 utilized to support that engine version would be the associated color.

Additionally, the bases 20*a-c* for each support assembly 14*a-d* may have different interface heights $H_I$ than one another. That is, the interface height $H_I$ for the base 20*a* of the support assembly 14*a* may differ from the interface height of the base 20*a* of the support assembly 14*b* which differs from the interface height of the base 20*a* of the support assemblies

14*c* and 14*d*. Alternatively, all the bases 20*a-c* may be the same height and shims located between the base 20*a-c* and the platform 12 can be used to adjust the interface height $H_I$ for each base 20*a-c*. The interface height $H_I$ for the bases 20*a-c* is determined by the component mount requirement at each support assembly 14*a-d* location for that version of the component.

Figure 3:
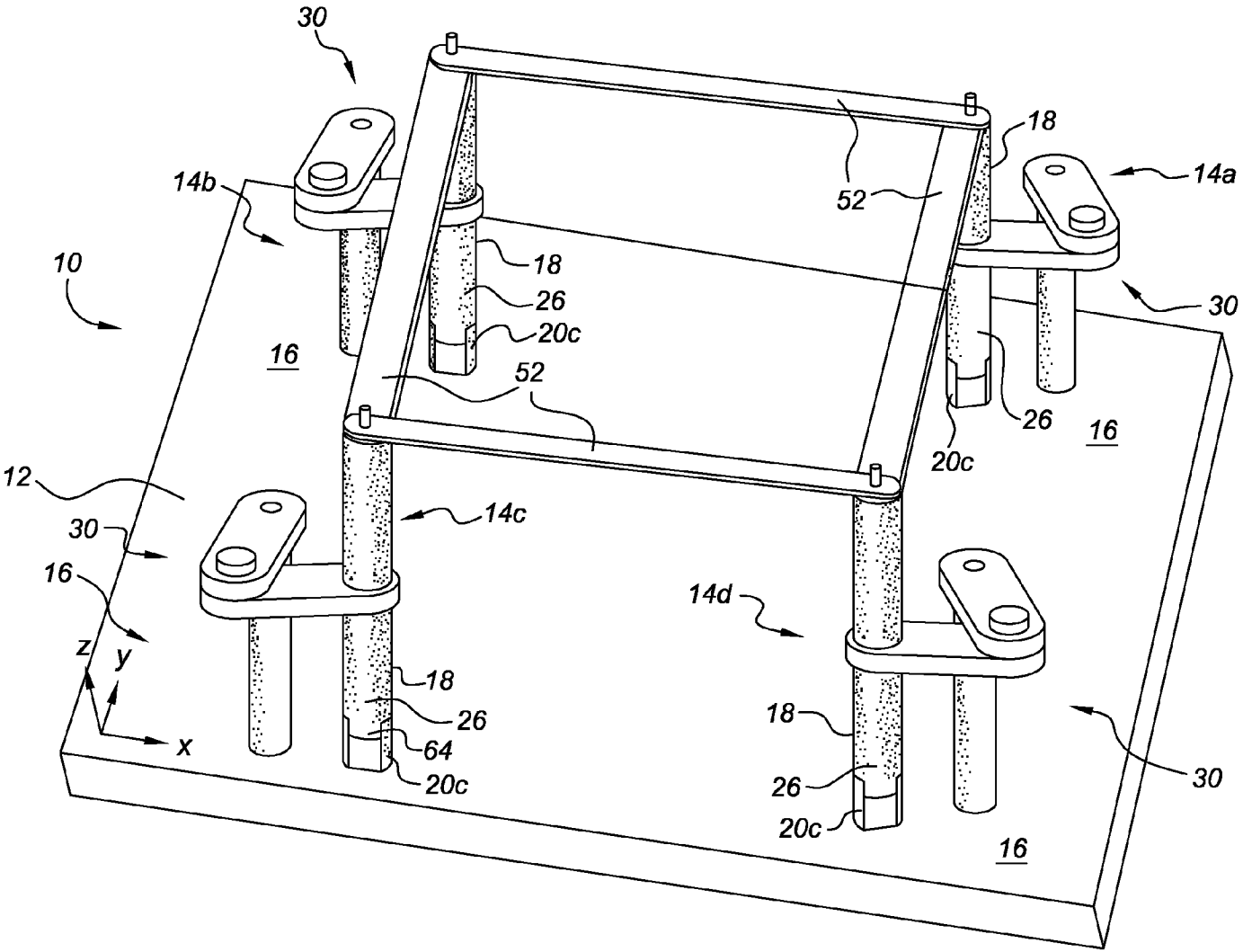
FIG. 3 is a perspective view illustrating the reconfigurable pallet of the present invention supporting a component.

FIG. 3 illustrates support of one version of a component on the pallet 10. The support elements 18 and bases 20*c* for the one version of the component are shown. The remaining bases 20*a* and *b* of the support assemblies 14*a-d* are removed for simplicity. The component to be supported is represented by rigid links 52. Each interface 28 has an extension 54 (shown in FIGS. 4 and 5) and a wall 56. The wall 56 of the interface 28 aligns the support element 18 and the footing 26 with the base 20*c*. The extension 54 assists in aligning the support element 18 and the footing 26 and absorbs lateral forces, in the x or y direction, caused by the component during movement of the pallet 10.

Figure 4:
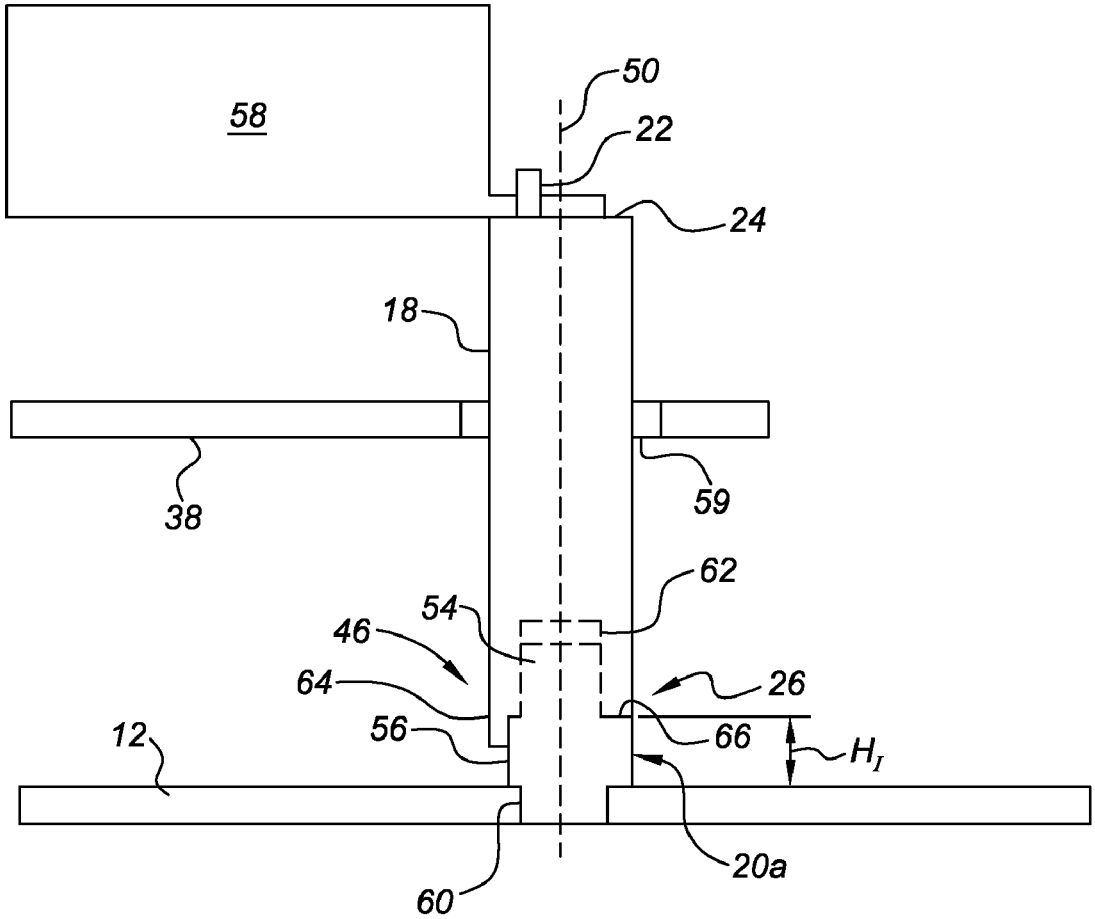
FIG. 4 is a side view of one support element located in a base of the support assembly for the pallet of the present invention

FIG. 4 is a side view of one support element 18 located in a base 20*a*. The component is represent by an element 58 mounted on the locator 22. The base 20*a* is secured to the platform 12 with a press fit between the platform 12 and a fitting portion 60 such as by a serrated surface. Alternate securing approaches such as bolting, welding or clamping may also be used. The footing 26 of support element 18 defines a recess 62. The extension 54 of base 20*a* is received within the recess 62 of the support element 18. The footing 26 and extension 54 assist in absorbing lateral forces acting on the support element 18 by element 58. The second arm 38 of the linkage assembly 30 supports the support element 18. A bushing 59 may be located between the support element 18 and the second arm 38. The bushing 59 provides support to and allows rotational and vertical movement of the support element 18. Once the support element 18 is located on the base 20*a* the alignment mechanism 46 and the component 58 prevent rotational and vertical movement of the support element 18.

Figure 5:
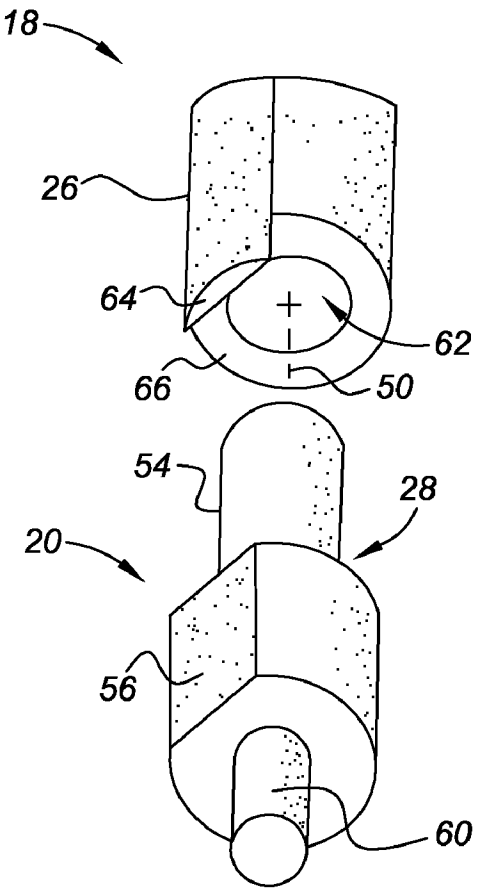
FIG. 5 is a perspective exploded view of one support element and base of the support assembly for the pallet of the present invention.

FIG. 5 is an exploded perspective view of the base 20 and the support element 18 illustrating the alignment mechanism 46. In addition to defining the recess 62 the footing 26 includes an elongated portion 64. The elongated portion 64 extends beyond an end 66 of the support element 18. When the extension 54 is received within the recess 62 the elongated portion 64 must align with the wall 56 of the base 20*a* to fully seat the support element 18 on the base 20*a*. The support element 18 can be rotated within aperture 42 (shown in FIG. 2) until the elongated portion 64 and wall 56 are in rotational alignment with one another.

It will be recognized by one skilled in the art that the alignment mechanism 46 comprises an asymmetric feature on base 20 and a complementary asymmetric feature on support 18 such that fully inserting support 18 into base 20 can be accomplished in only one rotational configuration. In the exemplar illustrated in FIG. 5, the features are separate and distinct from the extension 54 and recess 62 but these features could, without loss of utility be incorporated into extension 54 and recess 62.

The alignment mechanism 46 defines an extension 54 located on the base 20 and a recess 62 defined by the footing 26 of the support element 18. Alternatively, the support element 18 could define an extension including a planar wall and the base 20 could define a recess having a flat interior surface to align with the planar wall of the support element 18.

Figures 6A, 6B, 6C:
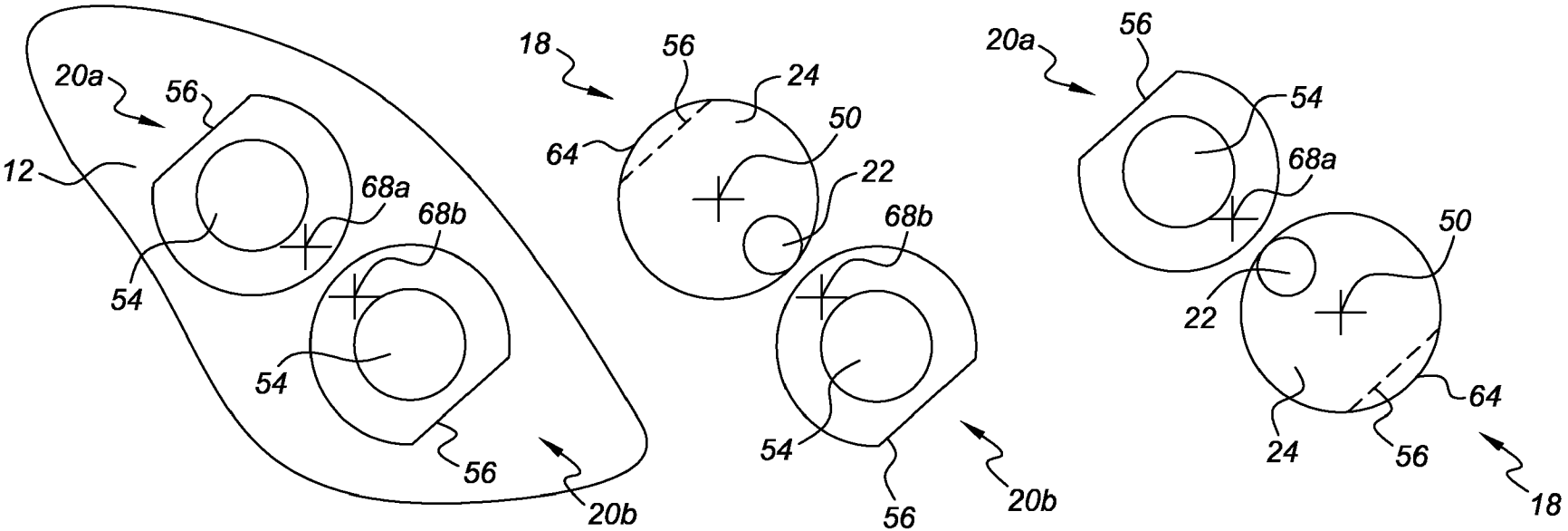
FIG. 6*a* is a schematic view illustrating alignment of multiple bases of the support assembly for the pallet of the present invention.
FIG. 6*b* is a schematic view illustrating alignment of one base and the support element with another base of the support assembly for the pallet of the present invention.
FIG. 6*c* is a schematic view illustrating alignment of one base with another base and the support element of the support assembly for the pallet of the present invention.

FIGS. 6*a*-6*c* illustrate the alignment of the footing 26 and the interface 28 to position the locator 22. FIG. 6*a* is a top view of the first base 20*a* and the second base 20*b* from one of the support assemblies 14. Desired mounting position 68*a* for a first version of the component and desired mounting position 68*b* for a second version of the component are indicated. The x-y coordinate distance between the desired mounting positions 68*a* and 68*b* is less then the distance from the center of the base 20*a* to the center of the base 20*b*. Thus, to get the locator 22 in the desired position the locator 22 must be positioned eccentric from the third axis 50 of the support element 18. A mechanism for positioning the locator 22 and the support element 18 in the correct rotational position relative to the base 20 is required. Aligning the elongated portion 64 on the support element 18 and the wall 56 on the base 20 allows the rotational position of the support element and the locator 22 to be set. When mounting the bases 20*a* and 20*b* to the platform 12 the walls 56 are oriented based upon the desired mounting positions 68*a-b* and the position of the locator 22 relative to the center of support element 18. Thus, by facing the walls 56 away from each other on a pair of bases 20*a* and 20*b*, two close points of support for the component may be provided.

FIG. 6*b* is a top view of the base 20*b* and the support element 18 positioned on base 20*a*. The locator 22 has an off-center location with respect to the support element 18. That is, the locator 22 is eccentrically located from the third axis 50 about which the support element 18 rotates. By aligning the elongated portion 64 with wall 56 the locator is rotated to the same position as the desired mounting position 68*a* (shown in FIG. 6*a*). Correspondingly, FIG. 6*c* is a top view of the base 20*a* and the support element 18 positioned on base 20*b*. The platform is, thus, configured to support a different version of the component. The locator 22 has the same eccentric location with respect to the third axis 50 of the support element 18 as shown in FIG. 6*b*. However, the support element 18 has been rotated to align the elongated portion 64 with wall 56 placing the locator 22 in the desired mounting position 68*b* (shown in FIG. 6*a*).

In the above embodiments an example of the component to be supported is an engine. This is in no way meant to be restrictive and other components may be utilized with the reconfigurable pallet of the present invention.

While the best modes for carrying out the invention have been described in detail, those familiar with the art to which this invention relates will recognize various alternative designs and embodiments for practicing the invention within the scope of the appended claims.

The invention claimed is:

1. A pallet for supporting a component for assembly operations comprising:

a plurality of support assemblies each mounted to a platform, wherein each of the plurality of support assemblies includes a support element which is rotatable and moveable to a plurality of positions, a plurality of bases each defining one of the plurality of positions, and wherein each of the plurality of bases is configured for selectively receiving the respective support element and has an alignment mechanism disposed with respect to the support element and configured to align the rotational position of the support element in each of the plurality of positions relative to the platform.

2. The pallet of claim 1, further comprising a plurality of linkage assemblies mounted to the platform, wherein each of the plurality of linkage assemblies is associated with one of the plurality of support assemblies to enable movement of the support element to the plurality of positions.

3. The pallet of claim 2, wherein the support element in each of the plurality of support assemblies is adjustable in a plurality of directions parallel to the platform via movement of a respective one of the plurality of linkage assemblies and adjustable in a direction perpendicular to the platform via the plurality of bases and sliding of the support element relative to the one of the plurality of linkage assemblies.

4. The pallet of claim 3, wherein each of the plurality of linkage assemblies further comprises a foundation secured to the platform, a first arm rotatably connected to the foundation and a second arm rotatably connected to the first arm, wherein the second arm defines an aperture to slideably and rotatably receive the support element.

5. The pallet of claim 1, wherein the alignment mechanism comprises an asymmetric feature on each of the plurality of bases and a complementary feature on the support element whereby slidable engagement of the support element and each of the plurality of bases can occur in only one rotational configuration.

6. The pallet of claim 1, wherein the alignment mechanism comprises a planar wall located on one side of each of the plurality of bases.

7. The pallet of claim 6, wherein each support element further comprises a locator positioned at a first end of the support element, a footing positioned at a second end of the support element, wherein the footing defines a recess, and an elongated portion extending from the footing beyond the second end.

8. The pallet of claim 7, wherein each of the plurality of bases comprises an extension extending vertically, the extension to be received by the recess in the footing of the support element, and wherein the extension is at a predetermined height corresponding to a desired height for the locator.

9. The pallet of claim 8, wherein the elongated portion is alignable with the planar wall prior to the extension being received within the recess.

10. A support assembly for a reconfigurable pallet comprising:

a linkage assembly secured to a platform;

a support element rotatably and slideably mounted to the linkage assembly;

a plurality of bases for selectively receiving the support element; and an alignment mechanism associated with each base and configured to align the rotational position of the support element relative to the base.

11. The support assembly of claim 10, wherein the linkage assembly further comprises a foundation secured to the platform, a first arm rotatably connected to the foundation and a second arm rotatably connected to the first arm, wherein the second arm defines an aperture to slideably and rotatably receive the support element.

12. The support assembly of claim 11, wherein the support element further comprises a locator positioned at a first end of the support element, a footing positioned at a second end of the support element, wherein the footing defines a recess, and an elongated portion extending from the footing beyond the second end.

13. The pallet of claim 12, wherein the alignment mechanism comprises an asymmetric feature on each of the plurality of bases and a complementary feature on the support element whereby slidable engagement of the support element and each of the plurality of bases can occur in only one rotational configuration.

14. The support assembly of claim 12, wherein each of the plurality of bases comprises an extension extending vertically, the extension to be received by the recess in the footing of the support element, and wherein the extension is at a predetermined height corresponding to a desired height for the locator.

15. The support assembly of claim 14, wherein the alignment mechanism comprises a planar wall located on one side of each of the plurality of bases.

16. The support assembly of claim 15, wherein the wall is aligned with the elongated portion prior to the extension being received within the recess.

17. The support assembly of claim 15 wherein a pair of the plurality of bases are oriented sufficiently close together so that the planar wall on each of the pair of bases when facing substantially away from each other may permit the locator on the support element mountable on each of the pair of the bases to provide two close points of support.

* * * * *